US008337056B2

(12) United States Patent
Alter et al.

(10) Patent No.: US 8,337,056 B2
(45) Date of Patent: Dec. 25, 2012

(54) ENCLOSURE FOR A RECESSED LIGHT IN AN ATTIC

(75) Inventors: Harry A. Alter, Granville, OH (US); Anthony L. Rockwell, Pickerington, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 479 days.

(21) Appl. No.: 12/699,339

(22) Filed: Feb. 3, 2010

(65) Prior Publication Data

US 2011/0069498 A1 Mar. 24, 2011

Related U.S. Application Data

(63) Continuation-in-part of application No. 29/343,842, filed on Sep. 21, 2009, now Pat. No. Des. 629,556.

(51) Int. Cl.
*F21S 8/00* (2006.01)
*F21V 15/00* (2006.01)

(52) U.S. Cl. ..... 362/364; 52/28; 174/58; 362/147; 362/365; 362/376

(58) Field of Classification Search ..... 52/28, 173.3, 52/200; 174/58; 362/145, 147, 148, 364–366, 362/376

See application file for complete search history.

(56) References Cited

U.S. PATENT DOCUMENTS

| | | | | |
|---|---|---|---|---|
| 863,178 | A * | 8/1907 | Holt et al. | 362/361 |
| 1,179,720 | A * | 4/1916 | Hart | 206/815 |
| 2,419,510 | A * | 4/1947 | Van Rosen | 229/115 |
| 2,789,752 | A | 4/1957 | Will | |
| 4,120,024 | A * | 10/1978 | Aizenberg et al. | 362/96 |
| 4,237,671 | A | 12/1980 | Munson | |
| 4,375,142 | A * | 3/1983 | McDonald | 52/28 |
| 4,400,766 | A | 8/1983 | Munson | |
| 4,754,377 | A | 6/1988 | Wenman | |
| 5,014,170 | A * | 5/1991 | Gawad et al. | 362/260 |
| 5,128,850 | A * | 7/1992 | Juodvalkis | 362/352 |
| 5,571,280 | A * | 11/1996 | Lehrer | 362/352 |
| 6,067,759 | A * | 5/2000 | House | 52/198 |
| 6,079,856 | A * | 6/2000 | Prestier | 362/365 |
| 6,102,568 | A * | 8/2000 | Davis | 383/43 |
| 6,105,334 | A | 8/2000 | Monson et al. | |

(Continued)

FOREIGN PATENT DOCUMENTS

EP 0908668 A2 4/1999

(Continued)

OTHER PUBLICATIONS

PCT International Search Report and the Written Opinion, PCT/US2010/043864 filed Jul. 30, 2010, dated Oct. 20, 2010.

*Primary Examiner* — Nimeshkumar Patel
*Assistant Examiner* — Steven Horikoshi
(74) *Attorney, Agent, or Firm* — MacMillan, Sobanski & Todd, LLC

(57) ABSTRACT

An enclosure for a recessed light in an attic is transformable between a first configuration in which the enclosure is flat and a second configuration in which the enclosure defines a housing. The housing has an opening at a bottom end for receiving the recessed light and an upwardly-facing surface opposite the opening. The upwardly-facing surface has a variable height relative to the bottom end.

17 Claims, 4 Drawing Sheets

U.S. PATENT DOCUMENTS

| | | | | |
|---|---|---|---|---|
| 6,123,438 | A | 9/2000 | Hentz | |
| 6,286,980 | B1 | 9/2001 | Meyer | |
| 6,508,567 | B1 * | 1/2003 | Fiene | 362/147 |
| D494,859 | S * | 8/2004 | Keberlein | D9/416 |
| 6,838,618 | B2 | 1/2005 | Newbold et al. | |
| 6,872,885 | B1 | 3/2005 | Newbold, Jr. | |
| 7,470,048 | B2 | 12/2008 | Wu | |
| 7,473,005 | B2 | 1/2009 | O'Brien | |
| 7,503,145 | B2 | 3/2009 | Newbold et al. | |
| 2004/0257803 | A1 * | 12/2004 | Kermoade | 362/223 |
| 2005/0005517 | A1 | 1/2005 | Weder et al. | |
| 2008/0087557 | A1 | 4/2008 | Evans et al. | |
| 2008/0180961 | A1 | 7/2008 | Gibson et al. | |
| 2012/0134162 | A1 * | 5/2012 | Hanacek | 362/364 |

FOREIGN PATENT DOCUMENTS

| | | | |
|---|---|---|---|
| FR | 2895489 | A1 | 6/2007 |
| GB | 638729 | | 6/1950 |
| GB | 2270936 | A | 3/1994 |
| GB | 2348603 | A | 10/2000 |
| GB | 2428913 | A | 2/2007 |

* cited by examiner

ENCLOSURE FOR A RECESSED LIGHT IN AN ATTIC

TECHNICAL FIELD

This invention relates generally to an apparatus for enclosing a recessed light in an attic.

BACKGROUND OF THE INVENTION

In residential and commercial buildings it is common to insulate ceilings by blowing cellulose or fiberglass loose fill insulation material in the attic to a predetermined height. Alternatively, the ceiling can be covered with rolls of fiberglass batt. It is also common for recessed lighting to extend into the attic from the ceiling. If the insulation covers the recessed light, the insulation can trap heat. The temperature of the recessed light can rise and result in damage to the light or to the surrounding materials that have been used in the construction of the ceiling.

SUMMARY OF THE INVENTION

According to this invention there is provided an enclosure for a recessed light in an attic. The enclosure is transformable between a first configuration in which the enclosure is flat and a second configuration in which the enclosure defines a housing. The housing has an opening at a bottom end for receiving the recessed light and an upwardly-facing surface opposite the opening. The upwardly-facing surface has a variable height relative to the bottom end.

Various advantages of this invention will become apparent to those skilled in the art from the following detailed description of the preferred embodiment, when read in light of the accompanying drawings.

DETAILED DESCRIPTION OF EXEMPLARY EMBODIMENTS

Figure 1:
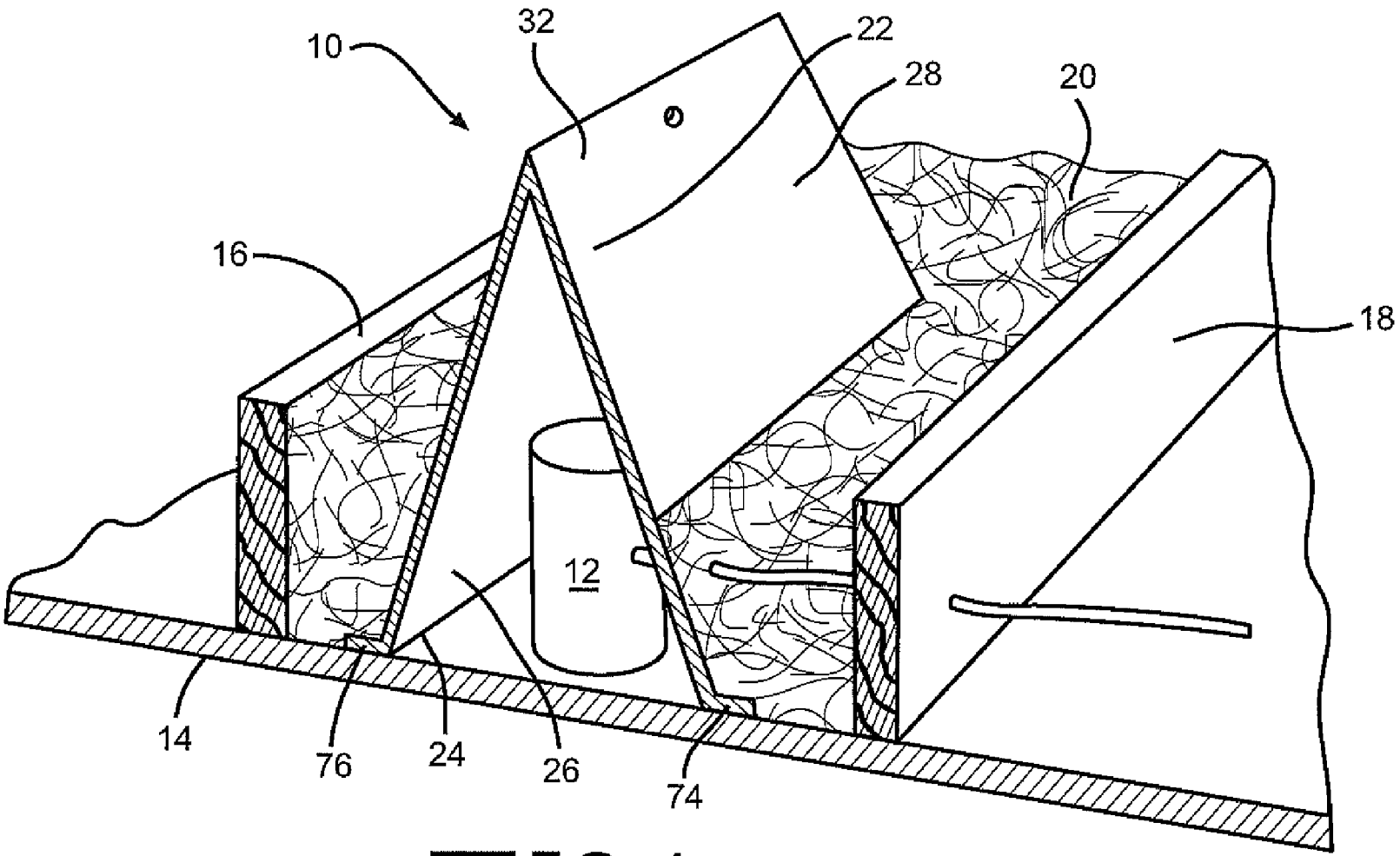
FIG. 1 is a perspective and cut-away view of a first embodiment applied in a first operating environment.

A plurality of different embodiments is shown in the Figures of the application. Similar features are shown in the various embodiments. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The embodiments disclosed herein allow heat generated by a recessed light to more readily escape to the attic. The enclosures disclosed below have slanted or sloped surfaces that deflect loose fill insulation. The loose fill will therefore not accumulate on the enclosures and trap heat. The embodiments thus provide a way of passively preventing the accumulation of insulation above the recessed light.

According to a first embodiment, an enclosure 10 for a recessed light 12 in an attic is shown in FIG. 1. The light 12 extends into an attic above a ceiling 14. The light 12 is mounted in the ceiling 14 between two framing members 16 and 18. The enclosure 10 surrounds the light 12. Insulation 20 fills the cavity between the framing members 16 and 18 and surrounds a lower portion of the tent-shaped and partially cut-away enclosure 10.

FIG. 1 shows the enclosure 10 in a second configuration in which the enclosure 10 defines a housing 22. The second configuration is one in which the housing 22 is formed by opening a flat box-like structure into a three-dimensional form. As will be described below, the enclosure 10 is transformable between the second configuration and a first configuration in which the enclosure 10 is flat.

The housing 22 has an opening 24 at a bottom end 26 for receiving the recessed light 12 and an upwardly-facing surface 28 opposite the opening 24. The housing 22 extends a predetermined height along a vertical axis from the ceiling 14 between the bottom end 26 and a top end 32. The height of the housing 22 can be selected based on the height of insulation necessary for a particular R value. For example, if the insulation to be installed in the attic requires a height of 20 inches to achieve an R value of 60, the height of the housing can be greater than 20 inches. It is advantageous for the top end 32 to be higher than the expected height of the insulation so that heat generated by the light 12 can more readily escape into the attic.

The bottom end 26 can be fixed to the ceiling 14 with adhesive or any other means if desired. Alternatively, the enclosure 10 can rest upon the ceiling 14. After the enclosure 10 has been positioned over the light 12, the cavity between the framing members 16 and 18 can be filled with the insulation 20. The exemplary insulation 20 can be loose fill insulation suitable for being blown into the insulation cavity defined between the members 16 and 18. In other embodiments, the insulation can be rolls of fiberglass batt or any other form of insulating material.

The upwardly-facing surface 28 opposite the opening 24 has a variable height relative to the bottom end 26. The surface 28 can be sloped, angled, and/or canted relative to horizontal. The height increases for positions along the upwardly-facing surface 28 closer to a center of the enclosure 10, such as above the light 12. The perimeter of the exemplary enclosure 10 continuously converges from the bottom end 26 to the top end 32 to form a tent shape. During installation of the insulation, particles of loose fill insulation 20 can thus deflect off or slide down the upwardly-facing surface 28, allowing the top end 32 to remain exposed in the attic. The surface 28 can be formed with low friction materials to further enhance sliding movement of the loose fill insulation off of the enclosure 10.

Figure 2:
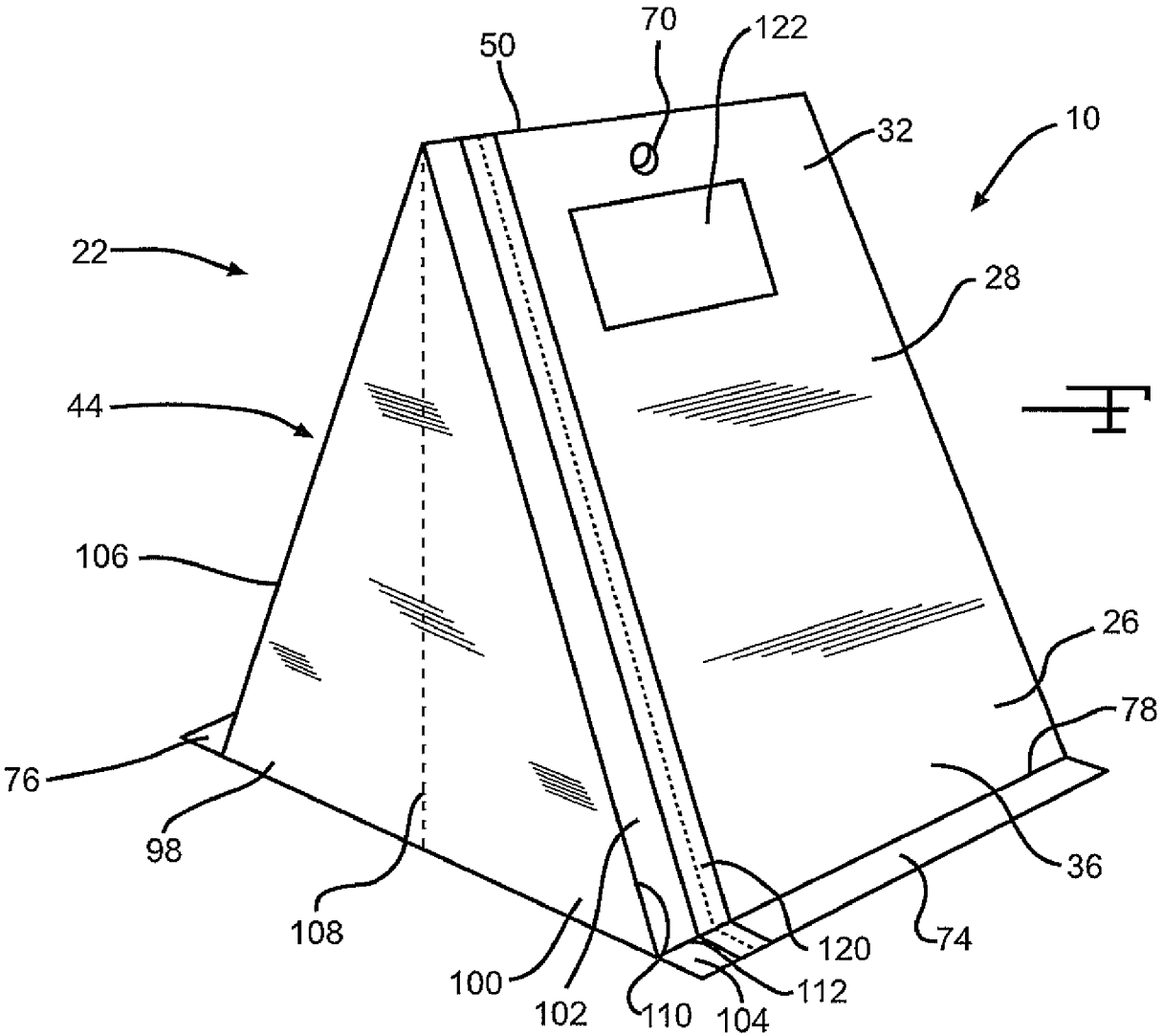
FIG. 2 is a perspective view of the first embodiment outside of the first operating environment.
Figure 3:
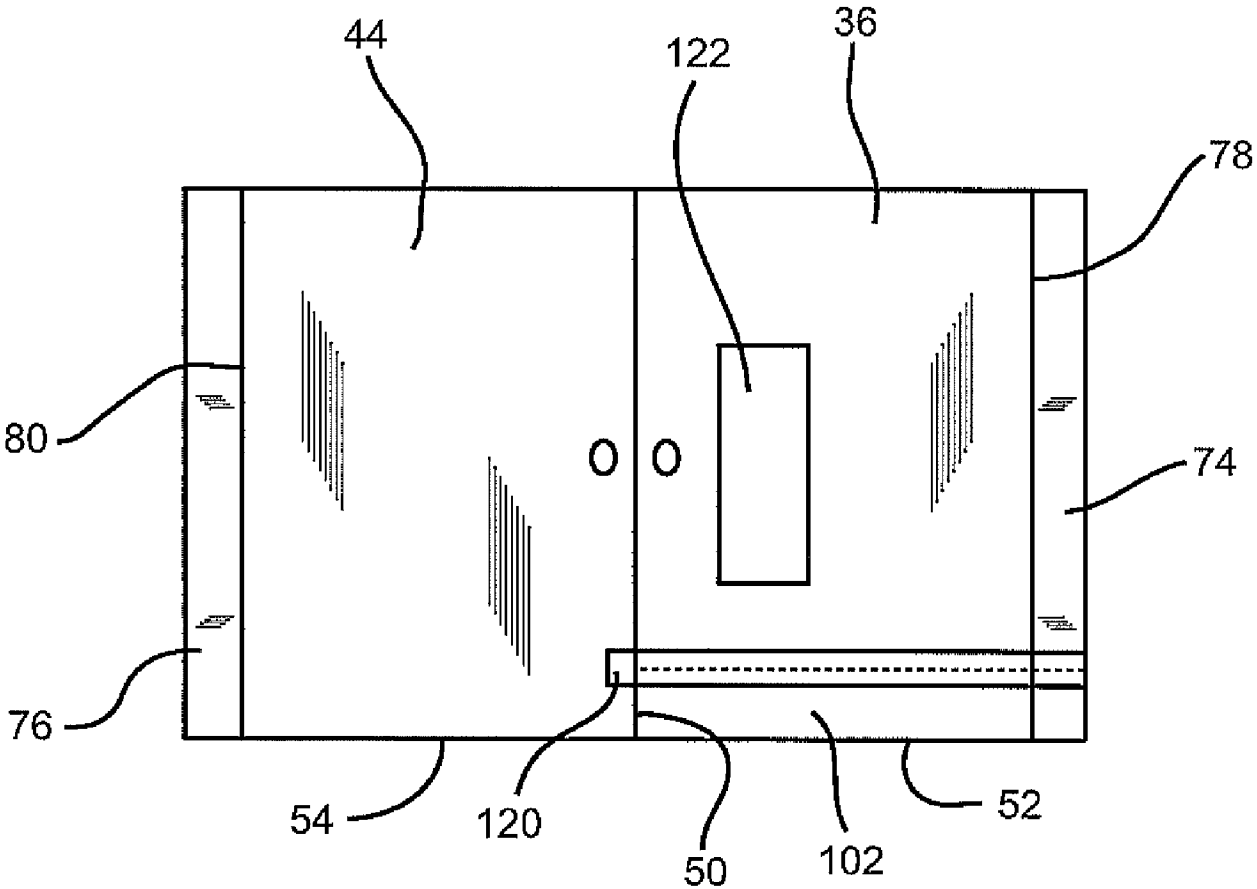
FIG. 3 is a top view of the second embodiment.
Figure 4:
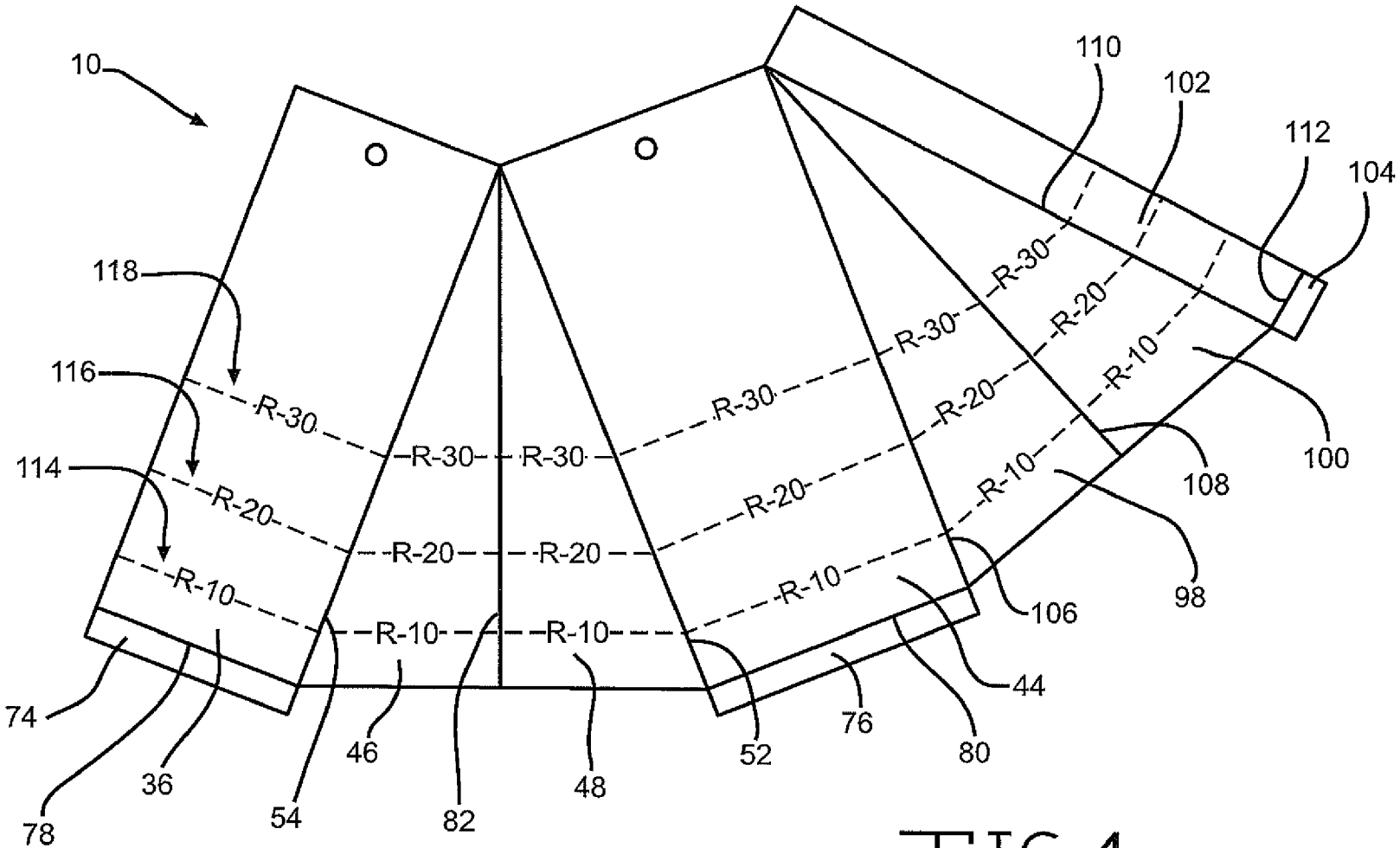
FIG. 4 is a top view of a blank for forming a third embodiment.

FIGS. 2-4 show the enclosure 10 out of the exemplary operating environment. The housing 22 is defined in part by panels 36, 44, 46, 48, 98, 100, and 102. The panels 36 and 44 are on opposite sides of the housing 22 and contact one another along an edge 50. The edge 50 can extend horizontal or substantially parallel to the bottom end 26. The panels 36 and 46 can be connected for pivoting movement relative to one another along a hinge or fold line 54. The panels 46 and 48 can be connected for pivoting movement relative to one another along a hinge or fold line 82. The panels 48 and 44 can be connected for pivoting movement relative to one another along a hinge or fold line 52. The panels 44 and 98 can be connected for pivoting movement relative to one another along a hinge or fold line 106. The panels 98 and 100 can be connected for pivoting movement relative to one another along a hinge or fold line 108. The panels 100 and 102 can be connected for pivoting movement relative to one another along a hinge or fold line 110. The panels 46 and 48 can enclose a front end of the housing 22 and panels 98 and 100 can enclose a rear side of the housing 22.

A single panel can be formed from a single material or from a plurality of different materials. Embodiments which include a plurality of panels can include one or more panels of relatively more rigid material to enhance the structural stability of the housing. Such embodiments can also include one or more panels that are relatively less thermally-resistant material to enhance the passage of heat out of the housing. The material used for forming one or more of the relatively more rigid panels of the embodiments described above can be metal, fiberglass-reinforced gypsum, fiberglass cloth, rigid fiberglass board, or a fiberglass veil. Other materials can be used as well to the extent that such materials conform to relevant building codes.

The hinges 52, 54, 82, 106, 108, 110 can be living hinges wherein the panels 36, 44, 46, 48, 98, 100, 102 and the hinges 52, 54, 82, 106, 108, 110 are integrally formed. Alternatively, the hinges 52, 54, 82, 106, 108, 110 can be formed separately from the panels 36, 44, 46, 48, 98, 100, 102. It is noted that all the fold or hinge lines in embodiments of the invention may incorporate either perforated lines or continuous crush lines to form an easy to fold crease in the material. Some folds which fold in the opposite direction than other folds may have a combination of the two treatments to assist in providing an easy to fold item.

The exemplary embodiment can also include panels 74, 76, and 104. The panels 74, 76, 104 can be integral with the panels 36, 44, 102, respectively, or can be separately formed. The panels 74, 76, 104 can be pivoted relative to the panels 36, 44, 102 to project laterally from the housing 22. Each of the panels 74, 76, 104 can define feet or tabs of the housing 22. In operation, the panels 74, 76, 104 can abut framing members 16 and/or 18 to keep the housing 22 in position as loose fill insulation is blown around the housing 22.

As best shown in FIG. 4, the enclosure 10 can be flat (a first configuration) prior to assembly. The enclosure 10 can be a single layer in the first configuration. The enclosure 10 can be transformed into the second configuration (a housing) by pivoting the panels 36, 44, 102 about hinges 52, 54, 110 until the panel 102 abuts or overlaps the panel 36. The panels 36 and 102 can be fixed together, such as with tape 120, adhesive, staples, or any other fixing structure. The panel 104 can cooperate with the panel 74 to define a foot for the first vertically-sloped side of the enclosure 10.

During the transformation of the enclosure 10 between the first and second configurations, the panels 46 and 48 can remain coplanar and the panels 98 and 100 can remain coplanar. Thus, hinges 82 and 108 can be omitted in some embodiments. However, the hinges 82 and 108 can be desirable if the enclosure 10 is transformed back to the first configuration. For example, the enclosure 10 can be folded substantially flat without disconnecting the panels 44 and 102 by folding the panels 46 and 48 about the hinge 82 and by folding the panels 98 and 100 about the hinge 108.

It is noted that the enclosure 10 can include at least one aperture spaced from the bottom end 26. One or more apertures could be formed in one or both of the panels 36, 44. Alternatively, one or both of the panels 36, 44 could be formed with score lines to allow the user to selectively remove portions of the respective panel 36 and/or 44.

The purpose of an aperture in one of the panels 36, 44 could be to vent the interior of the housing 22 to the attic after the insulation has been positioned; to define an aperture for grasping, carrying and positioning the housing 22; and/or to allow electrical wiring to pass to the light 12. Alternatively, the enclosure 10 can remain intact, without apertures, to enhance sealing of the interior of the building relative to the attic. In the exemplary embodiment, an aperture 70 can be used to handle the housing 22 and also to vent heat from the housing 22. The aperture 70 is shown as being slot-like with semi-circular ends, but could be circular, square, triangular, or any other shape in alternative embodiments of the invention.

Enclosures according to various embodiments can include an additional components or indicia to identify a desired level for surrounding insulation. FIG. 2 shows that embodiments can include a label 122 affixed to one of the panels. A plurality of substantially parallel lines can be visible on the label 122. The lines can correspond to R-values of insulation. For example, the lines can assist an attic insulation installer in achieving a particular R-value of insulation. The insulation can be installed until a height of the insulation reaches the line corresponding to the desired R-value. Alternatively, the lines can be formed or printed directly on an exterior of the housing. FIG. 4 shows a plurality of R-value indication lines 114, 116, 118. The lines 114, 116, 118 can be printed indicia, embossed, or be defined by any other visible medium.

The principle and mode of operation of this invention have been described in its preferred embodiments. However, it should be noted that this invention may be practiced otherwise than as specifically illustrated and described without departing from its scope.

What is claimed is:

1. An enclosure for a recessed light in an attic transformable between a first configuration in which the enclosure is flat and a second configuration in which the enclosure defines a housing having an opening at a bottom end configured to receive the recessed light and an upwardly-facing surface opposite the opening with a variable height relative to the bottom end, and wherein the enclosure further comprises first and second vertically-sloped sides and first and second vertically-straight sides.

2. The enclosure of claim 1 wherein the enclosure includes a plurality of panels each defining portions of the upwardly-facing surface and at least one hinge interconnecting two of the plurality of panels.

3. The enclosure of claim 2 wherein the at least one hinge is further defined as a living hinge.

4. The enclosure of claim 1 wherein the enclosure includes at least one aperture spaced from the bottom end.

5. The enclosure of claim 1 wherein the first and second vertically-sloped sides are each defined by single panels and first and second vertically-straight sides are each defined by a plurality of panels.

6. The enclosure of claim 1 wherein the enclosure is a single layer in the first configuration.

7. The enclosure of claim 1 wherein the enclosure is tent-shaped.

8. The enclosure of claim 1, wherein the vertically-sloped sides are configured to deflect loosefill insulation.

9. The enclosure of claim 1, wherein the enclosure has a height, and wherein in an installed position the height of the enclosure is greater than a height of an insulation surrounding the enclosure.

10. The enclosure of claim 9, wherein the height of the insulation is 20.0 inches.

11. The enclosure of claim 1, wherein the bottom end is configured for attachment to a ceiling with an adhesive.

12. The enclosure of claim 1, wherein in an installed position the enclosure has a top end configured to remain exposed in the attic after insulation has been installed.

13. The enclosure of claim 1, wherein the vertically-sloped sides are formed from low friction materials.

14. The enclosure of claim 1, wherein the vertically-sloped sides can be formed by adjacent panels.

15. The enclosure of claim 14, wherein the adjacent panels are configured to be attached together by tape.

16. An enclosure for a recessed light in an attic transformable between a first configuration in which the enclosure is flat and a second configuration in which the enclosure defines a housing having an opening at a bottom end configured to receive the recessed light and an upwardly-facing surface opposite the opening with a variable height relative to the bottom end, and wherein the enclosure includes a plurality of panels formed from different materials such that one panel is made from a material different from the material of another panel.

17. An enclosure for a recessed light in an attic transformable between a first configuration in which the enclosure is flat and a second configuration in which the enclosure defines a housing having an opening at a bottom end configured to receive the recessed light and an upwardly-facing surface opposite the opening with a variable height relative to the bottom end, and wherein the enclosure includes one or more panels that are relatively less thermally-resistant material.

* * * * *